US006068522A

United States Patent [19]

Aoyama et al.

[11] Patent Number: 6,068,522

[45] Date of Patent: May 30, 2000

[54] BLOCK CONNECTOR

[75] Inventors: Masahiko Aoyama; Mitsugu Furutani; Hitoshi Okumura, all of Mie; Yuji Hatagishi; Kimihiro Abe, both of Shizuoka; Kouichi Shirouzu, Aichi, all of Japan

[73] Assignees: Sumitomo Wiring Systems, Ltd., Mie; Yazaki Corporation, Tokyo, both of Japan

[21] Appl. No.: 09/114,214

[22] Filed: Jul. 13, 1998

[30] Foreign Application Priority Data

Jul. 14, 1997 [JP] Japan ..... 9-188648

[51] Int. Cl.[7] ..... H01R 13/502

[52] U.S. Cl. ..... 439/701

[58] Field of Search ..... 439/594, 595, 439/599, 701, 717, 718, 752

[56] References Cited

U.S. PATENT DOCUMENTS

| | | | |
|---|---|---|---|
| 5,122,077 | 6/1992 | Maejima et al. . | |
| 5,288,250 | 2/1994 | Sumida . | |
| 5,551,896 | 9/1996 | Hess et al. | 439/701 |
| 5,890,933 | 4/1999 | Okabe | 439/701 |

FOREIGN PATENT DOCUMENTS 5-65073 8/1993 Japan .

*Primary Examiner*—Khiem Nguyen
*Attorney, Agent, or Firm*—McGinn & Gibb, P.C.

[57] ABSTRACT

A connector in which the deformation of lock portions is prevented, and the connector can have a compact design, and housings are prevented from being displaced with respect to each other in both longitudinal and transverse directions. Transverse grooves of a dovetail shape are formed respectively in widthwise opposite ends of an upper surface of a lower housing at a front end portion thereof, and longitudinal grooves of a dovetail shape are formed in a widthwise central portion of this upper surface. Transverse ribs of a dovetail shape are formed respectively at widthwise opposite ends of a lower surface of an upper housing at a front end portion thereof, and longitudinal grooves of a dovetail shape are formed on a widthwise central portion of this lower surface. The transverse ribs are greater in projecting height than the longitudinal ribs. When the ribs are press-fitted respectively into the associated grooves, the two housings are locked together. When an external force of above a predetermined level is applied so as to separate the two housings from each other, the ribs are withdrawn respectively from the grooves, thereby disconnecting the two housings from each other.

18 Claims, 7 Drawing Sheets

BLOCK CONNECTOR

BACKGROUND OF THE INVENTION

1. Field of the Invention

This invention relates to a block connector constituted by stacking a plurality of housings together.

2. Related Art

One known conventional block connector is shown in FIG. 8. This block connector is constituted by stacking three connector housings a one upon another, and a rear half of an upper side of each housing a is open so that wires can be press-connected respectively to metal terminals (not shown) mounted in the housing. The upper one of any two adjacent housings a has retaining piece portions b projecting downwardly respectively from front and rear end portions of each of opposite side surfaces thereof, while the lower housing a has retaining projections c corresponding respectively to the retaining piece portions b. When the housings a are stacked together, each retaining piece portion c is elastically engaged with the associated retaining projection c of the lower-side housing a, so that the housings a are connected together to be assembled into the block connector of an integrated construction.

In the conventional block connector, the lock portions, formed on the housings a for holding the adjacent housings a in a mutually-connected condition, are exposed to the outer surfaces of the housing a, and therefore for example, when the block connector is caused to strike against other member, there is a possibility that the retaining piece portion b is deformed or damaged, and another problem is that since the projected portions are formed on the side surfaces of the connector, the connector has an increased width.

SUMMARY OF THE INVENTION

It is an object of this invention to provide a block connector having lock means which overcomes the above problems.

According to the present invention, there is provided a block connector comprising a plurality of housings stacked together; wherein ribs and grooves, which can be releasably engaged with each other, are provided at mating surfaces of the housings to be mated together, and the ribs as well as the grooves are directed in a transverse direction, defining a widthwise direction, and a longitudinal direction, defining a lengthwise direction, respectively.

Each of the ribs and each of the grooves have a dovetail shape, and each of the ribs can be fitted in the associated groove.

The transversely-directed ribs, as well as the transversely-directed grooves, are provided respectively at widthwise opposite ends of the housing, and the longitudinally-directed ribs, as well as the longitudinally-directed grooves, are provided at a widthwise central portion of the housing.

The transversely-directed ribs, provided respectively at the opposite ends, are greater in projecting height than the longitudinally-directed ribs provided at the widthwise central portion.

Lock means, comprising the ribs and the grooves, is provided at the mating surfaces of the housings, and is not exposed to the exterior, and therefore is prevented from accidental deformation and damage. And besides, the lock means is not projected from the outer surfaces of the housings, and therefore the overall size can be made compact. In addition, the ribs as well as the grooves are provided in the transverse and longitudinal directions, respectively, and therefore the housings are prevented from being displaced with respect to each other in both widthwise and longitudinal directions.

The two housings can be locked together by press-fitting the ribs respectively into the grooves, and when applying an external force of above a predetermined level so as to separate the two housings from each other, the ribs are withdrawn respectively from the grooves, thus enabling the disconnection of the two housings from each other.

The locking is effected at the widthwise opposite ends and the widthwise central portion of the housings, and therefore the housings can be connected together in such a manner that the housings will not be lifted relative to each other over the entire width.

The ribs at the opposite ends are fitted respectively into the associated grooves, and then the ribs at the central portion are fitted respectively into the associated grooves. The ribs at the opposite ends are first fitted, and therefore perform a registration function when the ribs at the central portion are to be fitted. And besides, since the ribs at the opposite ends and the ribs at the central portion are fitted separately, the assembling operation can be effected with a smaller fitting force as compared with the case where such ribs are all fitted at one time.

DETAILED DESCRIPTION OF THE PREFERRED EMBODIMENTS

A preferred embodiment of the present invention will now be described with reference to the accompanying drawings.

First Embodiment

Figure 1:
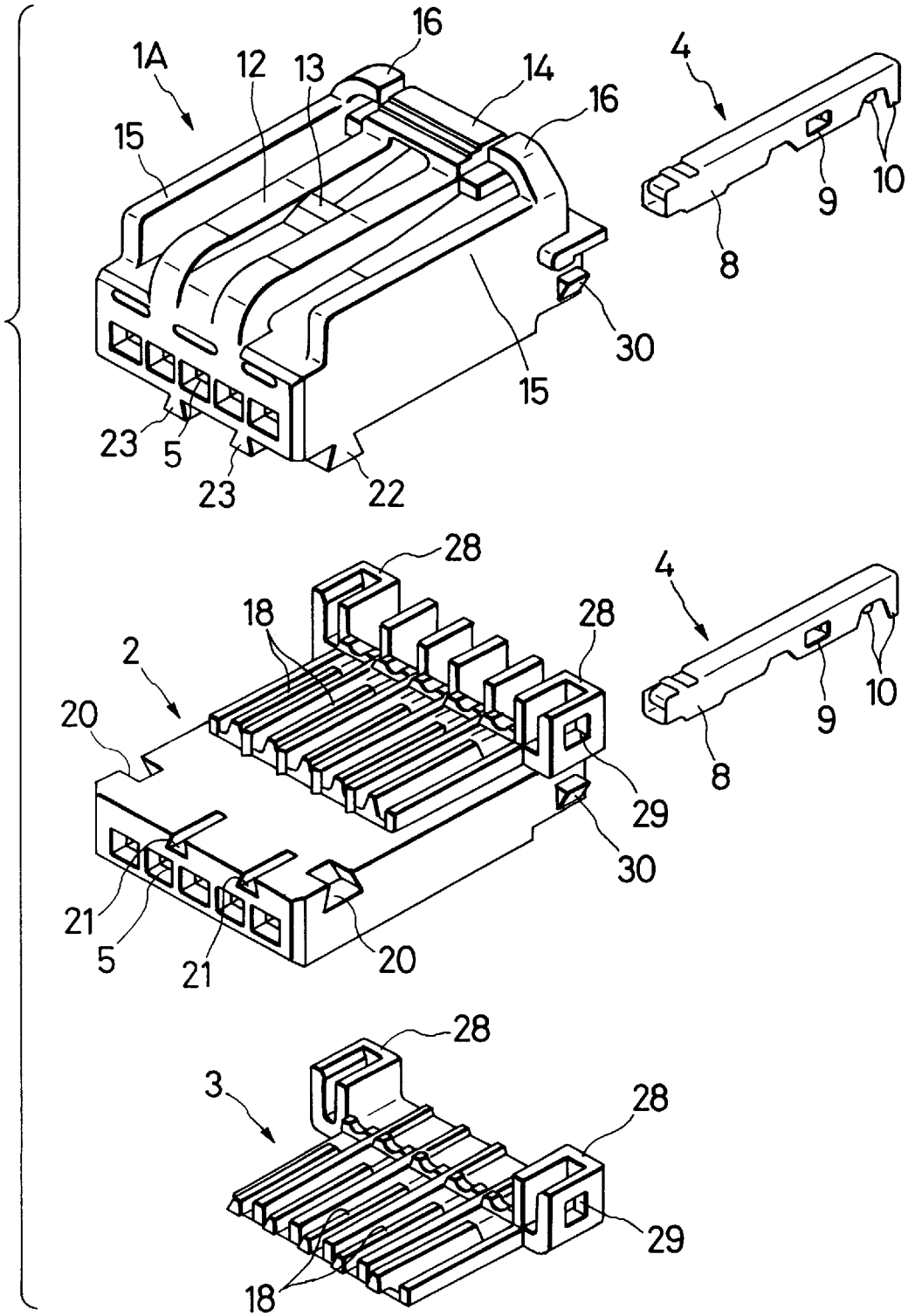
FIG. 1 is a perspective view of a first embodiment of a block connector of the present invention, showing a condition before it is assembled.
Figure 2:
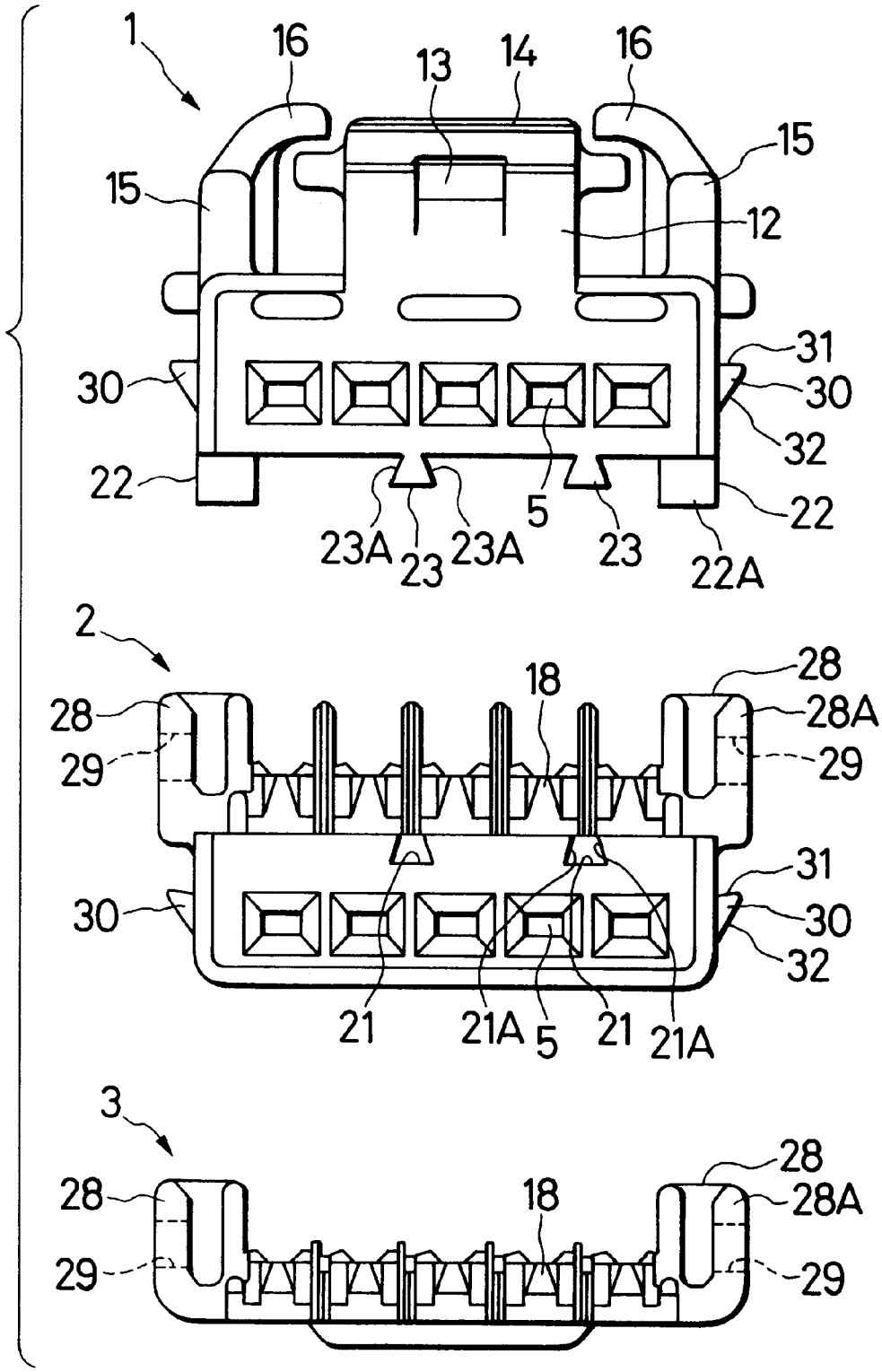
FIG. 2 is a front-elevational view of the block connector in FIG. 1.

A first embodiment of the present invention will now be described with reference to FIGS. 1 to 5. A block connector of this embodiment is a female-type connector. As shown in FIGS. 1 and 2, this block connector is constituted by stacking an upper housing 1 and a lower housing 2 together, and then by attaching a cover 3 to a lower surface of the lower housing 3. Wires W (see FIG. 5) can be press-connected respectively to female metal terminals 4 mounted respectively in cavities 5 formed in each of the two housings 1 and 2.

The female metal terminals 4 to be mounted in the housings 1 and 2 will be briefly described. The female metal terminal 4 is formed by bending an electrically-conductive metal sheet, and includes a connection portion 8 formed at its front portion (left-hand portion in FIG. 1) for receiving a tab of a mating male metal terminal, a press-connecting portion 9 provided rearwardly of the connection portion 8 for press-connecting a conductor of the wire W, and a barrel 10 provided rearwardly of the press-connecting portion 9 for clamping a sheath of the wire W.

Figure 3:
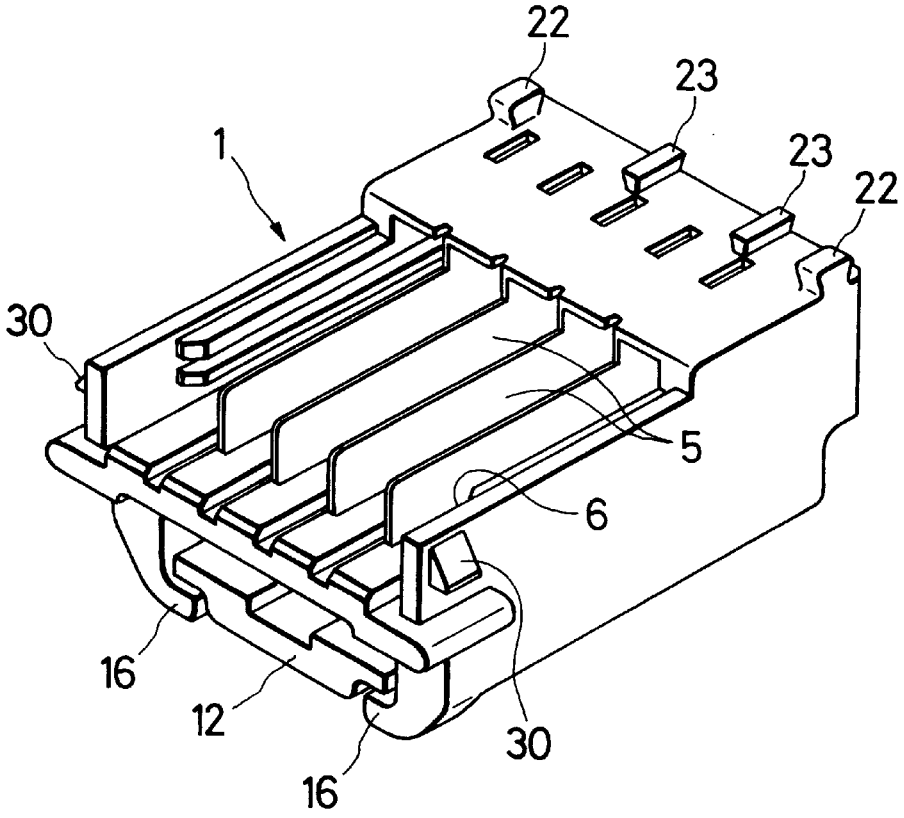
FIG. 3 is a perspective view of an upper housing in an inverted condition.

The upper housing 1 is molded of a synthetic resin, and the plurality of juxtaposed cavities 5 are formed in a row in this upper housing, and the female metal terminals 4 are inserted respectively into these cavities from the rear side (right side in FIG. 1) of the housing. As shown in FIG. 3, a rear portion of a lower surface of the upper housing 1 is open, and a press-connecting jig (not shown) can be inserted into the cavities 5 through this opening 6 to press-connect the wires W respectively to the female metal terminals 4 mounted respectively in the cavities 5.

A lock arm 12 is formed on an upper surface of the upper housing 1 in a cantilever manner, and a lock projection 13 for engagement with a mating connector housing is formed on this lock arm 12, and also a release operation portion 14 for flexing the lock arm 12 so as to release the locking engagement with the mating connector housing is formed on the lock arm 12. Protection walls 15 are formed respectively on right and left edge portions of the upper surface of the upper housing, and these projection walls 15 prevent foreign matters from intruding into a space beneath the lock arm 12. Warp limitation portions 16 for preventing the lock arm 12 from being warped or deformed in a direction opposite to the direction of flexing of the lock arm 12 are formed respectively on rear end portions of the protection walls 15.

The lower housing 2 is also made of a synthetic resin, and the plurality of juxtaposed cavities 5 are formed in a row in this lower housing as in the upper housing 1. The female metal terminals 4 are inserted respectively into the cavities 5 from the rear side of the housing. A rear portion of the lower surface of the lower housing 2 is open as in the upper housing 1, and the press-connecting jig (not shown) can be inserted into the cavities 5 through this opening to press-connect the wires W respectively to the female metal terminals 4 mounted respectively in the cavities 5.

A plurality of juxtaposed press ribs 18 are formed on an upper surface of the lower housing 2, and extend in a forward-rearward direction. When the lower surface of the upper housing 1 is placed on this upper surface, the press ribs 18 are pressed respectively against the wires W, press-connected respectively to the female metal terminals 4 mounted in the upper housing 1, to hold them.

The cover 3 is also made of a synthetic resin, and is formed into such a size as to close the opening in the lower housing 2. A plurality of juxtaposed press ribs 18 are formed on an upper surface of this cover, and extend in a longitudinal direction. When the cover 3 is attached to the lower housing 2 to close the opening in this housing, the press ribs are pressed respectively against the wires W, press-connected respectively to the female metal terminals 4 mounted in the lower housing 2, to hold them.

Next, lock mechanisms between the upper housing 1 and the lower housing 2 will be described. In this embodiment, the lock mechanisms are provided at the front side and the rear side, respectively.

Figure 4:
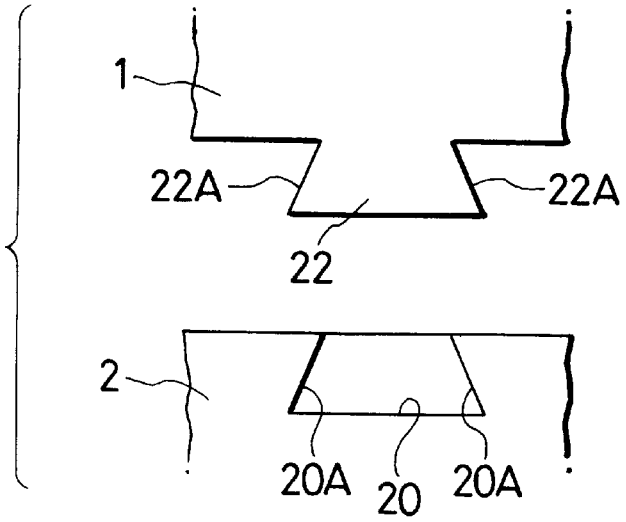
FIG. 4 is a fragmentary, side-elevational view, showing a condition in which a transverse groove and a transverse rib are spaced part from each other.
Figure 5:
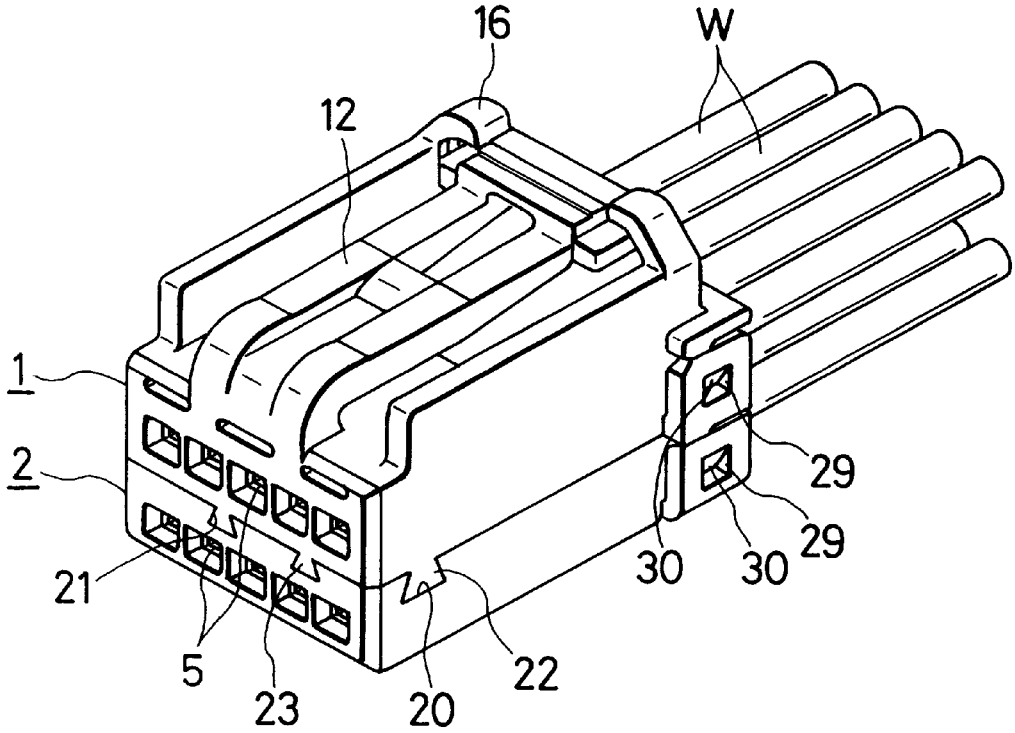
FIG. 5 is a perspective view of the block connector in an assembled condition.

Reference is first made to the front-side lock mechanism. Transverse grooves 20 of a predetermined size are formed respectively in the widthwise opposite ends of the upper surface of the lower housing 2, and are disposed adjacent to the front surface of this housing. As shown in FIG. 4, each of these transverse grooves 20 is formed into a dovetail shape. Two spaced-apart, longitudinal grooves 21 of a predetermined size are formed in the upper surface of the lower housing 2 at the front edge portion thereof, and are disposed at a widthwise central portion of this housing. As shown in FIG. 2, these longitudinal grooves 21 are also formed into a dovetail shape.

As shown in FIG. 3, transverse ribs 22 are formed respectively on those portions of the widthwise opposite ends of the lower surface of the upper housing 1 corresponding respectively to the transverse grooves 20. As shown in FIG. 4, these transverse ribs 22 are formed into a dovetail shape, and can be snugly fitted respectively in the transverse grooves 20. Two longitudinal ribs 23 are formed respectively on those portions of the front edge portion of the lower surface of the upper housing 1 corresponding respectively to the longitudinal grooves 21. As shown in FIG. 2, these longitudinal ribs 23 are formed into a dovetail shape, and can be snugly fitted respectively in the longitudinal grooves 21.

The transverse ribs 22 are larger in projecting height than the longitudinal ribs 23. Therefore, the transverse grooves 20 are greater in depth than the longitudinal grooves 21.

The transverse ribs 22 are press-fitted respectively into the transverse grooves 20, and therefore are kept fitted respectively in these grooves against withdrawal, and the longitudinal ribs 23 are press-fitted respectively into the longitudinal grooves 21, and therefore are kept fitted respectively in these grooves against withdrawal. When there is applied an external force serving to separate the upper and lower housings 1 and 2 from each other, each transverse rib 22 is guided by slanting surfaces 20A and 22A, and elastically expands an opening edge of the transverse groove 20, so that the transverse rib 22 can be withdrawn from the transverse groove 20. Each longitudinal rib 23 is guided by slanting surfaces 21A and 23A, and elastically expands an opening edge of the longitudinal groove 21, so that the longitudinal rib 23 can be withdrawn from the longitudinal groove 21.

Next, the rear-side lock mechanism will be described. Reception portions 28 for respectively receiving the rear end portions of the opposite (right and left) side walls of the upper housing 1 are formed respectively on the opposite (right and left) side edge portions of the upper surface of the lower housing 2 at the rear end portion thereof. A retaining hole 29 of a square shape is formed through an outer wall 28A of each of the reception portions 28. Retaining projections 30 for fitting respectively into the retaining holes 29 are formed on the opposite (right and left) side surfaces of the upper housing 1 at the rear end portion thereof. As shown in FIG. 2, this retaining projection 30 has a retaining surface 31, extending substantially perpendicularly from the side surface of the upper housing 1, and a downwardly-slanting guide surface 32.

Therefore, when the upper housing 1 is laid on the lower housing 2, each retaining projection 30 is forced into the reception portion 28, with the outer wall 28A elastically deformed along the guide surface 32, and when the retaining projection 30 is forced into a predetermined position, the wall 28A is elastically restored, and at the same time the retaining projection 30 is fitted into the retaining hole 29, and the reception portion 28 is retained by the retaining surface 31.

Reception portions 28 for respectively receiving the rear end portions of the opposite (right and left) side walls of the lower housing 2 are formed respectively at the opposite (right and left) ends of the cover 3 at the rear end portion thereof. A retaining hole 29 is formed through an outer wall 28A of each reception portion 28, and when the cover 3 is attached to the lower housing 2 to close the opening in this housing, retaining projections 30, formed respectively on the opposite (right and left) side surfaces of the lower housing 2, are fitted respectively into these retaining holes 29.

This embodiment has the above construction, and its operation will now be described.

For assembling the block connector, the female metal terminals 4 are mounted respectively in the cavities 5 of each of the housings 1 and 2, and then the wires W are press-connected respectively to the female metal terminals 4, using the press-connecting jig. The wires W, press-connected to the female metal terminals 4, are extended outwardly from the rear surface of each housing 1, 2.

Then, the upper housing 1 is laid on the upper surface of the lower housing 2. At this time, at the front side, the transverse ribs 22 (having a larger height) of the upper housing 1 are first press-fitted respectively into the transverse grooves 20 in the lower housing 2, while respectively expanding the opening edges thereof, and subsequently the longitudinal ribs 23 are press-fitted respectively into the longitudinal grooves 21 while respectively expanding the opening edges thereof. At the rear side, the retaining projections 30 of the upper housing 1 are guided by their respective guide surfaces 32, and are fitted respectively into the retaining holes 29, so that the retaining surface 31 of each retaining projection 30 is retained by the upper edge of the retaining hole 29. As a result, the two housings 1 and 2 are connected together in a stacked condition, with their mating surfaces mated with each other. Then, when the cover 3 is attached to the lower housing 3, the block connector-assembling operation is completed.

In the assembled condition, the ribs 22 are directed in the transverse direction while the ribs 23 are directed in the longitudinal direction, and also the grooves 20 are directed in the transverse direction while the grooves 21 are directed in the longitudinal direction, and therefore the upper and lower housings 1 and 2 are prevented from being displaced with respect to each other in both widthwise and longitudinal directions.

For disassembling the thus assembled block connector for repairing purposes or other purposes, this is effected in the following manner. First, the wall 28A of each reception portion 28 (constituting the rear-side lock portion) is flexed outwardly by the use of a disassembling jig (not shown), thereby disengaging the retaining projection 30 from the retaining hole 29, and a force, serving to separate the upper and lower housings 1 and 2 from each other, is applied. As a result, the longitudinal rib 23 of a smaller height is guided by the slanting surfaces 21A and 23A, and is withdrawn from the longitudinal groove 21 while expanding the opening edge thereof, and subsequently the transverse rib 22 is guided by the slanting surfaces 20A and 22A, and is withdrawn from the transverse groove 20 while expanding the opening edge thereof. Thus, the front-side locking is also released, and the upper and lower housings 1 and 2 are disconnected from each other.

As described above, in this embodiment, the following various advantages can be obtained. With respect to the front-side lock portion, the lock means (the transverse ribs 22 and the transverse grooves 20 and the longitudinal ribs 23 and the longitudinal grooves 21) is provided at the mating surfaces of the upper and lower housings 1 and 2, and is not exposed to the exterior, and therefore is prevented from accidental deformation and damage. And besides, the lock means is not projected from the side surfaces of the housings 1 and 2, and therefore the dimension in the widthwise direction can be made compact.

In addition, the ribs 22 and 23, as well as the grooves 20 and 21, are provided in the transverse and longitudinal directions, respectively, and therefore the upper and lower housings 1 and 2 are prevented from being displaced with respect to each other in both widthwise and longitudinal directions. And besides, the transverse ribs 22 are provided respectively at the widthwise opposite ends of the housing 1, and the transverse grooves 20 are provided respectively at the widthwise opposite ends of the housing 2, and the longitudinal ribs 23 are provided at the widthwise central portion of the housing 1, and the longitudinal grooves 21 are provided at the widthwise central portion of the housing 2, and therefore the two housings 1 and 2 are prevented from being lifted relative to each other over the entire width.

Furthermore, the transverse ribs 22, provided respectively at the widthwise opposite ends, are greater in height than the longitudinal ribs 23 provided at the central portion, and therefore the transverse ribs 22 are first fitted respectively into the transverse grooves 20, and therefore perform a registration function when the longitudinal ribs 23 are to be fitted respectively into the longitudinal grooves 21. And besides, the transverse ribs 22 and the longitudinal ribs 23 are fitted into the respective grooves in such a manner that their peaks are out of agreement with each other, and therefore the assembling operation can be effected with a smaller force as compared with the case where such ribs are fitted into respective grooves simultaneously.

Second Embodiment

Figure 6:
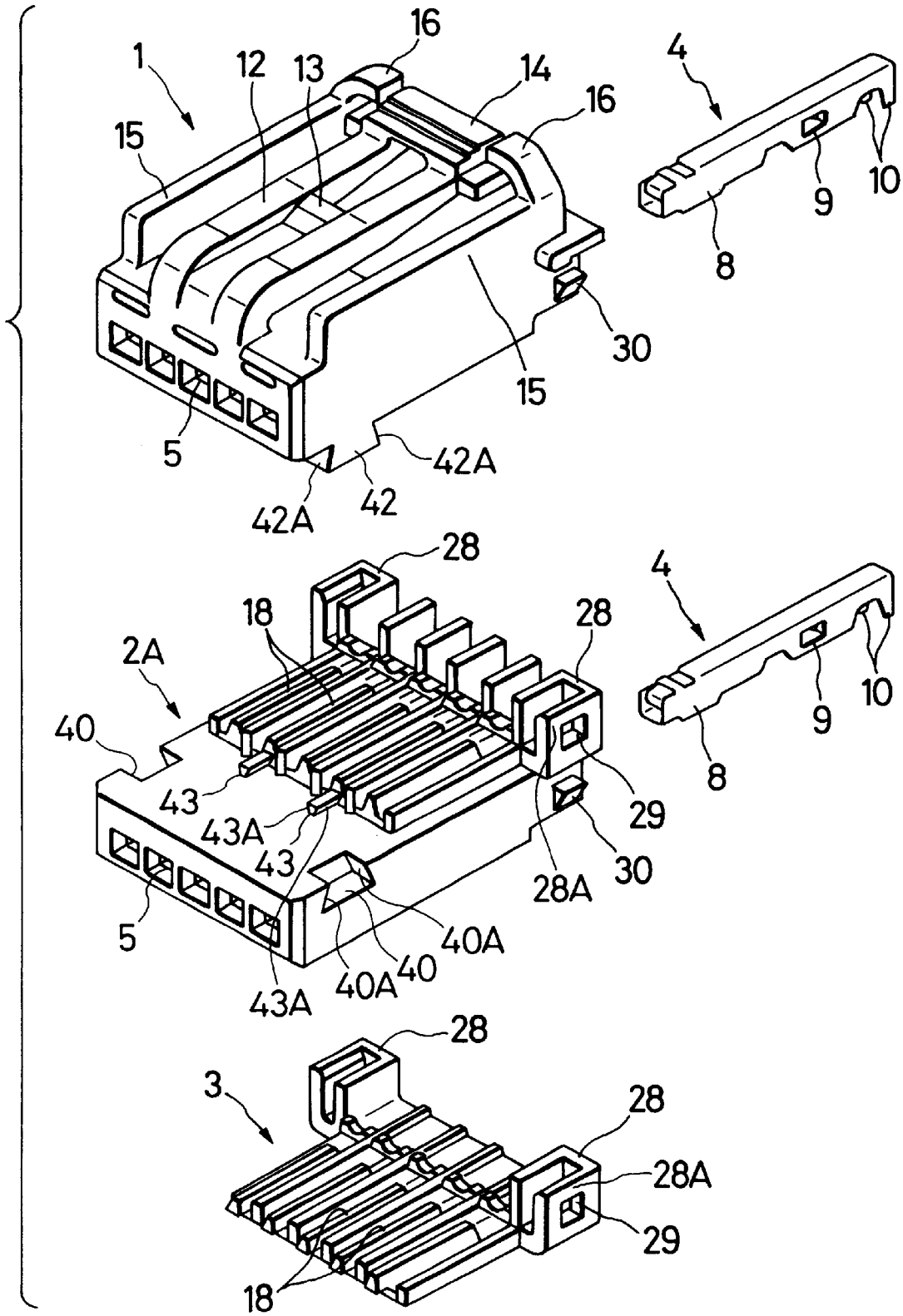
FIG. 6 is a perspective view of a second embodiment of a block connector of the invention, showing a condition before it is assembled.
Figure 7:
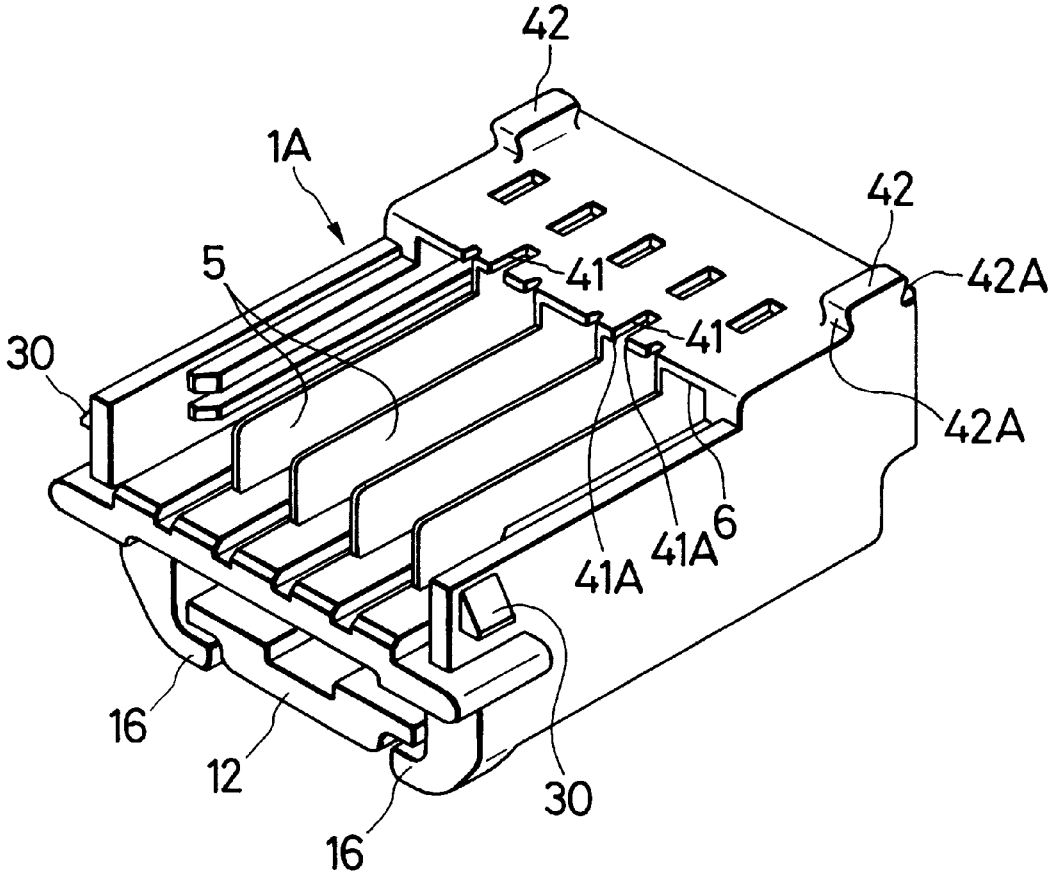
FIG. 7 is a perspective view showing an upper housing in an inverted condition.
Figure 8:
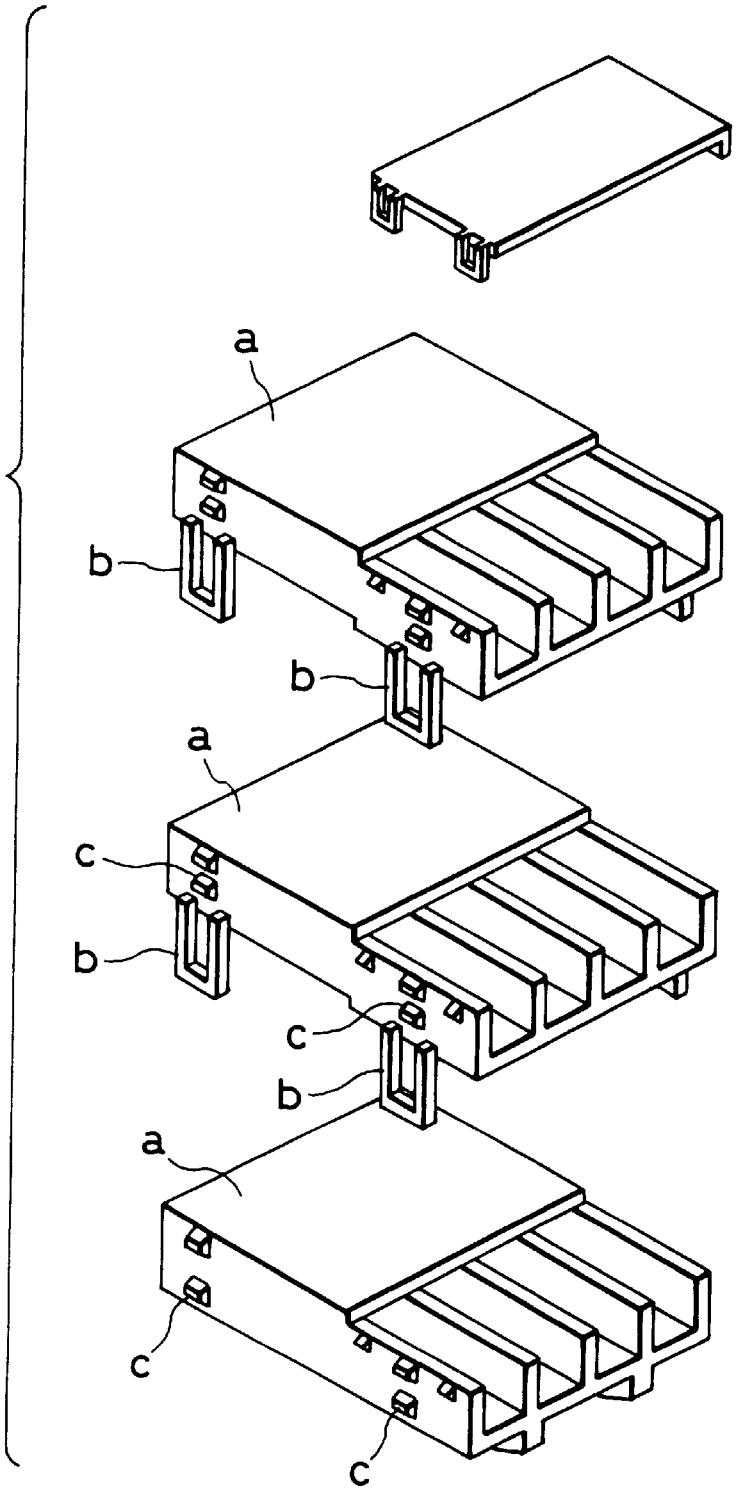
PRIOR ART FIG. 8
FIG. 8 is an exploded, perspective view of a conventional construction.

Next, a second embodiment of the present invention will be described with reference to FIGS. 6 and 7. This second embodiment differs from the above first embodiment in that the positions of formation of longitudinal grooves 41 and longitudinal ribs 43 of a front-side lock mechanism are changed.

More specifically, transverse grooves 40 of a dovetail shape are formed respectively in widthwise opposite ends of an upper surface of a lower housing 2A, and are disposed adjacent to a front surface of this housing, each of these grooves 40 having opposite side surfaces 40A which are slanting. Transverse ribs 42 of a dovetail shape are formed respectively on those portions of widthwise opposite ends of a lower surface of an upper housing 1A corresponding respectively to the transverse grooves 40, each of the transverse ribs 42 having opposite side surfaces 42A which are slanting.

The two spaced-apart, juxtaposed longitudinal grooves 43 of a dovetail shape are formed in the upper surface of the lower housing 2A, and are disposed at a widthwise central portion of this upper surface, and are spaced a predetermined distance from a front edge of this upper surface, each of these grooves 43 having opposite side surfaces 43A which are slanting. As shown in FIG. 7, the two longitudinal grooves 41 of a dovetail shape are formed respectively in those portions of the lower surface of the upper housing 1A corresponding respectively to the longitudinal ribs 43. Each of these grooves 41 is formed through a lower wall of the upper housing 1A, and is connected at one end to an opening 6, and has opposite side surfaces 41A which are slanting.

The transverse ribs 42 are larger in projecting height than the longitudinal ribs 43, and therefore the transverse grooves 40 are greater in depth than the longitudinal grooves 41.

The other construction is the same as that of the above first embodiment, and identical portions will be designated by identical reference numerals, respectively, and explanation thereof will be omitted.

The operation of this second embodiment is as follows. The upper housing 1A is laid on the upper surface of the lower housing 2A, and at this time, at the front side, the transverse ribs 42 of a larger height are first press-fitted respectively into the transverse grooves 40, while respectively expanding the opening edges thereof, and subsequently the longitudinal ribs 43 are press-fitted respectively into the longitudinal grooves 41 while respectively expanding the opening edges thereof. At the rear side, as described above in the first embodiment, retaining projections 30 are retainingly fitted respectively into retaining holes 29, and the two housings 1A and 2A are connected together in a stacked condition, with their mating surfaces mated with each other.

For disassembling the block connector, in this assembled condition, the rear-side lock portion is unlocked by the use of a disassembling jig, and an external force is applied so as to separate the front side portions of the two housings 1A and 2A from each other, and as a result, the transverse rib 42 is guided by the slanting surfaces 40A and 42A, and is withdrawn from the transverse groove 40 while expanding the opening edge thereof, and also the longitudinal rib 43 is guided by the slanting surfaces 41A and 43A, and is withdrawn from the longitudinal groove 41 while expanding the opening edge thereof. Thus, the front-side locking is also released, and the upper and lower housings 1A and 2A are disconnected from each other.

In this second embodiment, also, advantages similar to those of the first embodiment can be obtained. In addition, the longitudinal ribs 43 are provided at the widthwise central portion of the housing 2A, and are spaced a predetermined distance from the front edge, and also the longitudinal grooves 41 are provided at the widthwise central portion of the housing 1A, and are spaced a predetermined distance from the front edge, and therefore the two housings 1A and 2A are more positively prevented from being lifted relative to each other.

The present invention is not limited to the embodiments described above with reference to the drawings, and for example, the following embodiments will fall within the technical scope of the present invention. That is, the ribs, as well as the grooves, which are provided at the associated housing in the above embodiments, can be provided at the other housing. The present invention can be applied to a male-type block connector. Further, various modifications other than the above can be made without departing from the scope of the invention.

What is claimed is:

1. A block connector comprising a plurality of housings stacked together, wherein ribs and grooves, which can be releasably engaged with each other, are provided at mating surfaces of said housings to be mated together, and said ribs and said grooves are directed in a transverse direction and a longitudinal direction, said transverse direction defining a widthwise direction, wherein said transversely-directed ribs as well as said transversely-directed grooves, are provided respectively at widthwise opposite ends of said housing, and said longitudinally-directed ribs, as well as said longitudinally-directed grooves, are provided at a widthwise central portion of said housing, wherein said transversely-directed ribs, provided respectively at said opposite ends, are greater in projecting height than said longitudinally-directed ribs provided at said widthwise central portion.

2. A block connector according to claim 1, wherein each of said ribs and each of said grooves have a dovetail shape, and each of said ribs can be fitted in the associated groove.

3. A block connector comprising a plurality of housings stacked together, wherein ribs and grooves, which can be releasably engaged with each other, are provided at mating surfaces of said housings to be mated together, and said ribs and said grooves are directed in a transverse direction and a longitudinal direction said transverse direction defining a widthwise direction, wherein each of said ribs and each of said grooves have a dovetail shape, and each of said ribs can be fitted in the associated groove, wherein said transversely-directed ribs, as well as said transversely-directed grooves, are provided respectively at widthwise opposite ends of said housing, and said longitudinally-directed ribs, as well as said longitudinally-directed grooves, are provided at a widthwise central portion of said housing.

4. A block connector according to claim 3, wherein said transversely-directed ribs, provided respectively at said opposite ends, are greater in projecting height than said longitudinally-directed ribs provided at said widthwise central portion.

5. A block connector according to claim 1, wherein said housings include a first housing and a second housing, said longitudinally-directed ribs and said transversely-directed ribs are provided on said first housing and said longitudinally-directed grooves and said transversely-directed grooves are provided on said second housing.

6. A block connector according to claim 1, wherein said housings include a first housing and a second housing, said transversely-directed ribs and said longitudinally-directed grooves are provided on said first housing and said transversely-directed grooves and said longitudinally-directed ribs are provided on said second housing.

7. A block connector according to claim 1, wherein said longitudinally-directed grooves and said longitudinally-directed ribs are spaced a predetermined distance from a front edge of said block connector.

8. A block connector according to claim 1, wherein said longitudinally-directed grooves and said longitudinally-directed ribs are provided at a front edge portion of said block connector.

9. A block connector according to claim 3, wherein said housings include a first housing and a second housing, said longitudinally-directed ribs and said transversely-directed ribs are provided on said first housing and said longitudinally-directed grooves and said transversely-directed grooves are provided on said second housing.

10. A block connector according to claim 3, wherein said housings include a first housing and a second housing, said transversely-directed ribs and said longitudinally-directed grooves are provided on said first housing and said transversely-directed grooves and said longitudinally-directed ribs are provided on said second housing.

11. A block connector according to claim 3, wherein said longitudinally-directed grooves and said longitudinally-directed ribs are spaced a predetermined distance from a front edge of said block connector.

12. A block connector according to claim 3, wherein said longitudinally-directed grooves and said longitudinally-directed ribs are provided at a front edge portion of said block connector.

13. A block connector comprising:

a plurality of housings stacked together, wherein a plurality of ribs and a plurality of grooves are provided at mating surfaces of said housings, at least a first rib, a second rib, a first groove and a second groove are directed in a transverse direction, and at least a third rib, a fourth rib, a third groove and a fourth groove are directed in a longitudinal direction, said transverse direction defining a widthwise direction, wherein each of said ribs and each of said grooves have a dovetail shape, and each of said ribs can be fitted in the associated groove, wherein said first rib and said second rib are provided respectively at widthwise opposite ends of said housing, and said third rib and said fourth rib are provided at a widthwise central portion of said housing.

14. A block connector according to claim 13, wherein said transversely-directed ribs, provided respectively at said opposite ends, are greater in projecting height than said longitudinally-directed ribs provided at said widthwise central portion.

15. A block connector according to claim 13, wherein said housings include a first housing and a second housing, said longitudinally-directed ribs and said transversely-directed ribs are provided on said first housing and said longitudinally-directed grooves and said transversely-directed grooves are provided on said second housing.

16. A block connector according to claim 13, wherein said housings include a first housing and a second housing, said transversely-directed ribs and said longitudinally-directed grooves are provided on said first housing and said transversely-directed grooves and said longitudinally-directed ribs are provided on said second housing.

17. A block connector according to claim 13, wherein said longitudinally-directed grooves and said longitudinally-directed ribs are spaced a predetermined distance from a front edge of said block connector.

18. A block connector according to claim 13, wherein said longitudinally-directed grooves and said longitudinally-directed ribs are provided at a front edge portion of said block connector.

* * * * *